US011608666B2

(12) United States Patent
Brück et al.

(10) Patent No.: US 11,608,666 B2
(45) Date of Patent: Mar. 21, 2023

(54) CLOSING DEVICE FOR AN ELECTRICAL ENCLOSURE, AND A CORRESPONDING ELECTRICAL ENCLOSURE

(71) Applicant: RITTAL GMBH & CO. KG, Herborn (DE)

(72) Inventors: Daniel Brück, Sinn (DE); Sascha Wirbelauer, Weilburg-Odersbach (DE)

(73) Assignee: RITTAL GMBH & CO. KG, Herborn (DE)

( * ) Notice: Subject to any disclaimer, the term of this patent is extended or adjusted under 35 U.S.C. 154(b) by 351 days.

(21) Appl. No.: 16/765,488

(22) PCT Filed: Sep. 14, 2018

(86) PCT No.: PCT/DE2018/100783
§ 371 (c)(1),
(2) Date: May 20, 2020

(87) PCT Pub. No.: WO2019/101260
PCT Pub. Date: May 31, 2019

(65) Prior Publication Data

US 2020/0291697 A1 Sep. 17, 2020

(30) Foreign Application Priority Data

Nov. 22, 2017 (DE) ..... 10 2017 127 576.2

(51) Int. Cl.
*E05C 7/04* (2006.01)
*E05C 9/04* (2006.01)
*E05C 9/18* (2006.01)

(52) U.S. Cl.
CPC ..... *E05C 7/045* (2013.01); *E05C 9/04* (2013.01); *E05C 9/1808* (2013.01); *E05Y 2900/208* (2013.01)

(58) Field of Classification Search
CPC ..... E05C 7/045; E05C 9/04; E05C 9/1808; E05C 7/00; E05C 7/04; E05C 9/00;
(Continued)

(56) References Cited

U.S. PATENT DOCUMENTS 346,289 A * 7/1886 Kauffman ..... E05B 63/122 292/DIG. 21
2,227,803 A * 1/1941 Bales ..... E05B 65/025 70/264

(Continued)

FOREIGN PATENT DOCUMENTS

AU 2009251099 B2 5/2014
CA 2330794 A1 * 7/2001 ..... E05C 9/185

(Continued)

OTHER PUBLICATIONS

International Search Report (in English and German) and Written Opinion of the ISA (in German) issued in PCT/DE2018/100783, dated Nov. 30, 2018; ISA/EP.

(Continued)

*Primary Examiner* — Kristina R Fulton
*Assistant Examiner* — Steven A Tullia
(74) *Attorney, Agent, or Firm* — Harness, Dickey & Pierce, P.L.C.

(57) ABSTRACT

A locking device for a switch cabinet, with a lock door and a secondary door, wherein the secondary door, on a vertical outer edge opposite its hinge side, has a U-profile formed on a door leaf of the secondary door with a receptacle for a lock mechanism of the lock door, which receptacle is offset back relative to the door leaf and which is open towards the door leaf, wherein on an outer free profile side of the U-profile, a swivelling lever of a lock of the secondary door is pivotably mounted about an axis of rotation between an (Continued)

Figure 1:
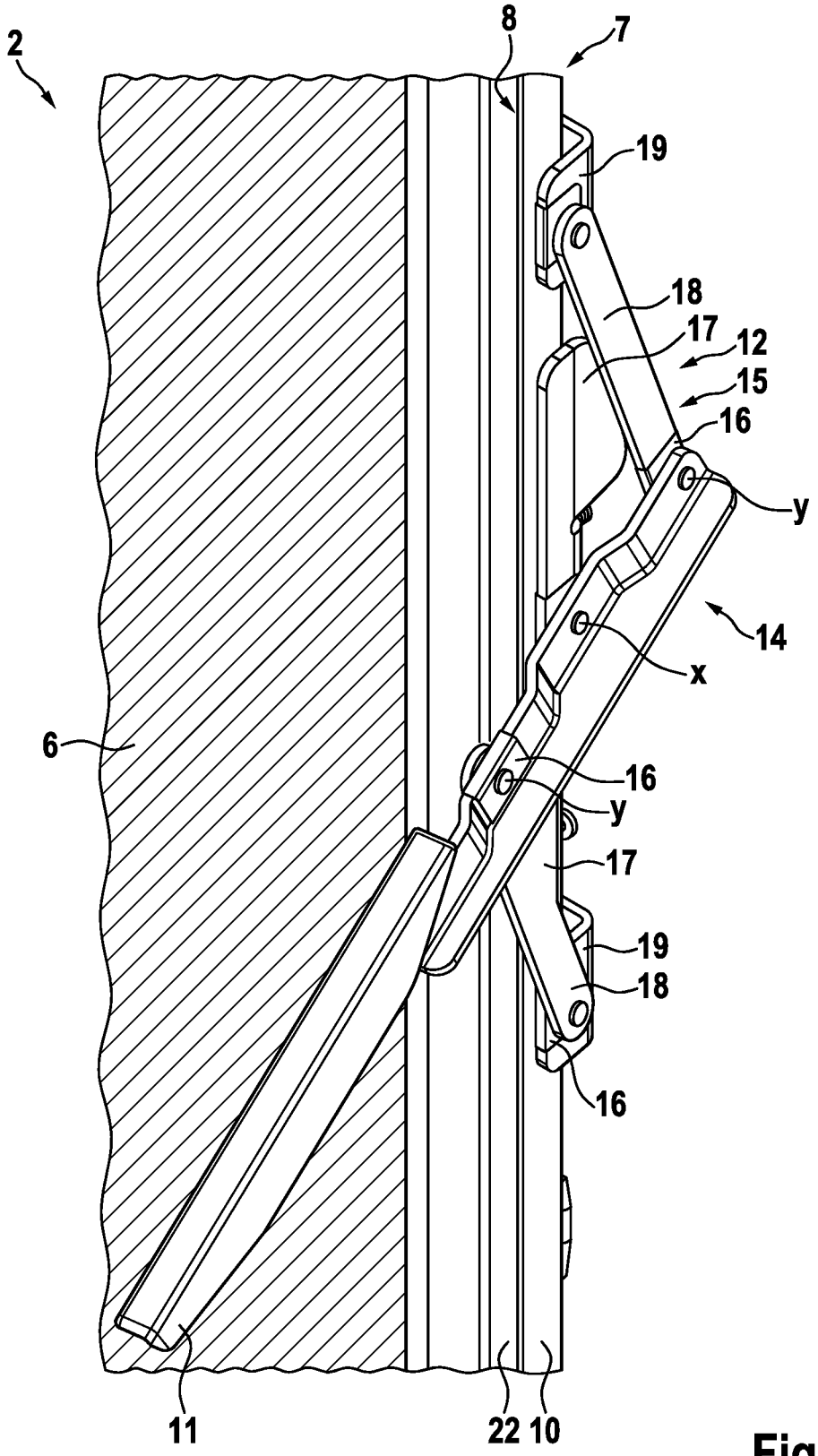

open position and a locking position. Furthermore, a corresponding switch cabinet is described.

20 Claims, 8 Drawing Sheets

(58) Field of Classification Search
CPC ..... E05C 9/006; E05C 9/008; E05C 9/042; E05C 9/043; E05C 9/048; E05C 9/10; E05C 9/14; E05C 9/16; E05C 9/22; E05Y 2900/208; E05B 15/0086; E05B 65/02; E05B 65/025; E05B 7/00; E05B 1/0092; Y10T 292/0801; Y10T 292/0834; Y10T 292/0836; Y10T 292/0839; Y10T 292/0844; Y10T 292/57; Y10S 292/21; Y10S 292/31; Y10S 292/49; G06F 1/1679; G06F 1/1681; G06F 1/1616; G06F 1/181
USPC ..... 49/394, 395, 366; 361/679.01, 679.58, 361/801, 726, 759, 724, 679.57
See application file for complete search history.

(56) References Cited

U.S. PATENT DOCUMENTS 2,800,103 A * 7/1957 Bleeker ..... A01K 1/0017 119/503
3,181,903 A 5/1965 Olander
3,622,187 A 11/1971 Emery
4,614,059 A * 9/1986 Trampe ..... E05F 15/614 49/357
4,973,091 A * 11/1990 Paulson ..... E05C 9/042 292/216
5,033,234 A * 7/1991 Simon ..... E05F 5/12 292/DIG. 21
5,326,162 A * 7/1994 Bovermann ..... H02B 1/34 312/265.3
6,019,446 A * 2/2000 Laboch ..... H02B 1/308 312/265.2
6,123,400 A * 9/2000 Nicolai ..... H02B 1/301 211/189
6,234,548 B1 * 5/2001 Mittelbach ..... E05B 85/16 292/336.3
6,250,015 B1 * 6/2001 Gillispie ..... E05F 5/12 312/324
6,425,610 B1 7/2002 Reuter et al.
6,508,494 B1 1/2003 Reuter et al.
8,287,021 B2 * 10/2012 Penner ..... E05B 83/16 292/336.3
9,549,482 B2 * 1/2017 Podemski ..... F16B 12/46
9,763,338 B2 * 9/2017 Hacking ..... G06F 1/183
9,871,353 B2 1/2018 Boehme et al.
9,991,684 B2 6/2018 Brueck et al.
10,277,014 B2 4/2019 Brueck et al.
2006/0207816 A1 * 9/2006 Marrs ..... B60J 7/185 180/69.21
2007/0210681 A1 * 9/2007 Adducci ..... H05K 7/183 312/328
2007/0227205 A1 * 10/2007 Hill ..... E05C 9/047 70/120
2011/0215600 A1 * 9/2011 Marko ..... E05B 3/00 292/336.3
2013/0193818 A1 * 8/2013 Sturm ..... E05C 9/043 292/164
2013/0213908 A1 * 8/2013 Hofmann ..... H02B 1/01 211/26
2016/0352080 A1 12/2016 Brueck et al.
2016/0352082 A1 12/2016 Boehme et al.
2016/0352083 A1 12/2016 Brueck et al.
2019/0182982 A1 * 6/2019 Gopalakrishna ... H05K 7/20172

FOREIGN PATENT DOCUMENTS

DE 571826 C * 3/1933
DE 1678157 A1 * 4/1967 ..... E05D 15/44
DE 7322741 U 11/1973
DE 4106959 C1 * 3/1991 ..... H02B 1/01
DE 19507192 A1 9/1996
DE 19806064 C1 9/1999
DE 19825417 A1 * 12/1999 ..... E05C 1/06
DE 10148793 A1 * 8/2002 ..... E05C 9/00
DE 10147989 A1 4/2003
DE 19946773 C2 6/2003
DE 102005004957 A1 8/2006
DE 202008007706 U1 10/2009
DE 202010011373 U1 10/2010
DE 202012100408 U1 3/2012
DE 102016117378 B3 5/2017
DE 102015121193 B4 7/2017
EP 0730074 A2 9/1996
EP 0786574 A1 * 11/1996 ..... E05C 9/041
EP 0965712 A2 * 5/1999 ..... E05C 9/041
GB 470433 A 8/1937
GB 2147047 A * 5/1985 ..... E05C 17/24
GB 2169952 A * 7/1986 ..... E05D 15/44
GB 2259947 A * 3/1993 ..... E05C 17/28
WO WO-9901632 A1 * 1/1999 ..... E05B 1/0092
WO WO-0147083 A1 * 6/2001 ..... H02B 1/01
WO WO-03029588 A1 4/2003
WO WO-2010027595 A2 * 3/2010 ..... G06F 3/03543

OTHER PUBLICATIONS

International Preliminary Report on Patentability (in German) issued in PCT/DE2018/100783, dated Feb. 7, 2020.

* cited by examiner

CLOSING DEVICE FOR AN ELECTRICAL ENCLOSURE, AND A CORRESPONDING ELECTRICAL ENCLOSURE

CROSS-REFERENCE TO RELATED APPLICATIONS

This application is a 371 U.S. National Phase of International Application No. PCT/DE2018/100783, filed on Sep. 14, 2018, which claims the benefit of German Patent Application No. 10 2017 127 576.2, filed on Nov. 22, 2017. The entire disclosures of the above applications are incorporated herein by reference.

BACKGROUND

This section provides background information related to the present disclosure which is not necessarily prior art.

TECHNICAL FIELD

The invention relates to a locking device for a switch cabinet, with a lock door and a secondary door, wherein the secondary door, on a vertical outer edge opposite its hinge side, has a U-profile formed on a door leaf of the secondary door with a receptacle for a lock mechanism for the lock door, which receptacle is offset back towards the switch cabinet interior relative to the door leaf and which is open towards the door leaf. Such a locking device is known from DE 198 06 064 C1. A similar locking device is also described in DE 199 46 773 C2.

DISCUSSION

The locking devices of the type described above, which are known from the state of the art, have the disadvantage that the mechanism to be manually operated for locking the secondary door can be accessed only inadequately when the lock door is open, which is due in particular to the fact that the lever to be manually pivoted for operating the secondary door lock is located on a side of the secondary door facing the switch cabinet interior and is therefore not visible to the user.

SUMMARY

This section provides a general summary of the disclosure, and is not a comprehensive disclosure of its full scope or all of its features.

It is therefore the aspect of the invention to further develop a locking device of the type described above in such a way that it is convenient to use.

Accordingly, it is provided that that on an outer free profile side of the U-profile, a swivelling lever of a lock of the secondary door is pivotably mounted about an axis of rotation between an open position and a locking position.

The outer free profile side may in particular be an outer end face of the secondary door, which extends at a right angle or an obtuse angle to the door leaf of the secondary door. When the swivelling lever of the secondary door lock is displaceable about the axis of rotation between the open position and the locking position, this axis of rotation may in particular extend perpendicularly to the end face, so that the swivelling lever between the open position and the locking position also moves substantially at the right angle or at the obtuse angle to the plane of the door leaf of the secondary door. The swivelling lever is thus accessible in every setting position from the front of the locking device, in particular thus also from the front of a switch cabinet, and, in contrast to the arrangement known from the state of the art, is not covered by the secondary door. The swivelling lever can be pivotable in a plane between the open position and the locking position, which extends parallel to the free profile side. In particular, the axis of rotation can extend perpendicular to the free profile side.

The free profile side can run at least approximately perpendicular or at an obtuse angle to the door leaf. In the open position, the swivelling lever can extend to the front of the secondary door beyond the door leaf plane. Furthermore, in the closing lever position, the swivelling lever can be arranged completely behind the door leaf plane. In particular, the swivelling lever can be situated in front of the outer free profile side of the U-profile or the end face of the secondary door, respectively.

The lock of the secondary door may comprise a first and a second push rod, to which the swivelling lever is mechanically coupled via a scissor element, the push rods extending along an outer side of a further profile side of the U-profile arranged on the rear side of the secondary door, which further profile side is formed by a bent edge on the outer free profile side of the U-profile.

The U-profile can be integrally formed with the door leaf of the secondary door. In particular, the U-profile can be formed by bending the door leaf of the secondary door on the vertical longitudinal edge of the secondary door opposite the hinge side of the secondary door. The U-profile can, for example, be formed by three consecutive 90° bent edges and/or obtuse angled bent edges of the door leaf. A suitable U-profile, which is integrally formed with the door leaf of the secondary door, is known from DE 198 06 064 C1.

The lock of the secondary door may comprise a first and a second push rod to which the swivelling lever is mechanically coupled via a scissor element, wherein a first toggle lever of the scissor element is connected at opposite ends to the first push rod and the swivelling lever via a respective first rotary connector and a second toggle lever of the scissor element is connected at opposite ends to the second push rod and the swivelling lever via a respective second rotary connector.

In each setting position of the swivelling lever, at least one of the toggle levers can overlap over its entire length with the outer free profile side of the U-profile or a pinch protection cover fixed thereto and projecting beyond it.

At least one of the toggle levers can be made in several parts or integrally formed. The toggle lever may have a toggle lever rod and a V-shaped pinch protection cover. The pinch protection cover can be integrally formed on the toggle lever rod or releasably connected to the toggle lever rod. The releasable connection can be a clip or plug connection, for example. The releasably connectable pinch protection cover can be a plastic moulding in particular. The pinch protection cover is intended in particular to prevent fingers from being pinched when adjusting the swivelling lever between the open position and the locking position when the toggle lever rods of the scissor element are swivelled relative to the outer free profile side of the U-profile with varying overlap between the toggle lever rod and the outer free profile side of the U-profile.

The toggle levers can each be connected to the respective push rod via an L-shaped coupling element. The coupling element can have a first attachment side which extends parallel to the outer free profile side of the U-profile and which has the rotary connector. The coupling element can also have a second attachment side, which is connected to the push rod and extends parallel to an outer side of a further profile side of the U-profile arranged at the rear of the secondary door.

A pinch protection cover can be fixed to the U-profile and extend parallel to the outer free profile side of the U-profile and protrude from the U-profile.

In the open position of the swivelling lever, a first of the toggle levers can extend parallel to the outer free profile side of the U-profile and protrude from the rear of the U-profile.

Furthermore, in the open position of the swivelling lever, a second toggle lever can extend parallel to the outer free profile side of the U-profile and protrude over the front of the U-profile.

The toggle levers may be attached to the swivelling lever oppositely with respect to the axis of rotation of the swivelling lever, wherein further axes of rotation of the rotary connectors connecting the toggle levers to the swivelling lever may be arranged between the toggle levers and the swivelling lever parallel to the axis of rotation of the swivelling lever.

In the open position of the swivelling lever, the other axes of rotation can be arranged oppositely in relation to the door leaf and protrude relative to the door leaf as well as the U-profile on opposite sides thereof, wherein, in the locking position of the swivelling lever, the other axes of rotation are situated in front of the outer free profile side of the U-profile.

According to another aspect, a switch cabinet is described which has a locking device of the type described above, the lock door and the secondary door being hinged to opposite vertical profiles of a frame of the switch cabinet, wherein in a closed position of lock door and secondary door the receptacle of the secondary door is covered by the lock door. A suitable switch cabinet frame as well as suitable hinges for the hinging of lock door and secondary door to the vertical profiles of the frame are known from DE 2016 10 117 378 B3.

The frame can have a horizontal strut which connects opposite ends of the vertical profiles to one another, wherein a sealing center piece with a profile receptacle open to the outer side of the frame is attached to the horizontal strut, and wherein a sealing element is accommodated in the profile receptacle which seals the U-profile at one of its longitudinal ends with respect to the profile receptacle.

The sealing center piece can be attached to a Z-edge of the horizontal strut, wherein an upper horizontal profile side of the Z-edge has a system perforation of regularly spaced fastening receptacles, wherein the sealing center piece has a passage aligned with one of the fastening receptacles for the free end of a push rod of the lock, and wherein the free end extends into the horizontal strut through the passage and the aligned fastening receptacle in the locking position of the swivelling lever. In the open position, the free end can be completely removed from the fastening receptacle and the aligned passage so that the secondary door is unlocked from the frame and can be swung away therefrom.

The sealing center piece can comprise a hard component having the profile receptacle and a soft component forming the sealing element. The sealing element can line the profile receptacle along its inner circumference, the sealing element having several sealing lips spaced parallel to one another and projecting horizontally from the inner circumference.

On a side facing the interior of the frame, the profile receptacle may have a cut-out into which a portion of the sealing element projects.

The hard component may have a passage for the free end of the push rod of the locking device, which passage is aligned with one of the fastening receptacles of a horizontal profile of the frame. The passage may be delimited by at least one horizontal inlet guide and preferably has two parallel inlet guides so that the free end of the push rod is guided in the horizontal direction, for example to provide tolerance compensation for the overall system. In this way, manufacturing tolerances of the switch cabinet, in particular of the frame and the locking system, can be compensated.

The passage may also have a run-up slope for seal compression extending perpendicular to the horizontal inlet guide and at an acute angle to the horizontal.

The hard component may have a centering dome on its rear side facing the vertical profile, via which centering dome the hard component engages in a fastening receptacle of the horizontal strut, so that the hard component is pre-positioned in relation to the horizontal strut.

The hard component can also have a substantially U-shaped clamping contour with which the hard component grips a profile web of the horizontal strut so that the hard component is aligned in a direction perpendicular to the horizontal strut.

The soft component can have several, in particular four, lamellas for sealing the switch cabinet, wherein three of the lamellas are configured for direct bearing against the U-profile formed on the secondary door.

A distribution of the locking force by offset bearing of the lamellas against the U-profile can be achieved by the lamellas having a different lamella length, with length decreasing in vertical direction from a first of the lamellas to a third of the lamellas.

By inclining the lamella, for example by 18° from the horizontal, a reproducible contacting of lamellas can be achieved when the door is closed. In particular, this achieves that the slats are always in contact opposite to the occurring water spray and are thus pressed against the door when subjected to water, so that an increased sealing effect is achieved. The free end faces of the sealing lamellas can have a corrugated contour.

A fourth lamella can extend over a door panel of the secondary door and can be used in particular to prevent water from entering from the floor or roof side of the switch cabinet. For this purpose, the lamella contacts the door panel under water pressure and thus closes or covers the U-shaped receptacle of the soft component.

Double sealing lips can be provided for increased IP protection. Furthermore, a form fit between the soft component and the hard component can be achieved, thus increasing soft component adhesion and dimensional stability in the critical sealing area.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 2:
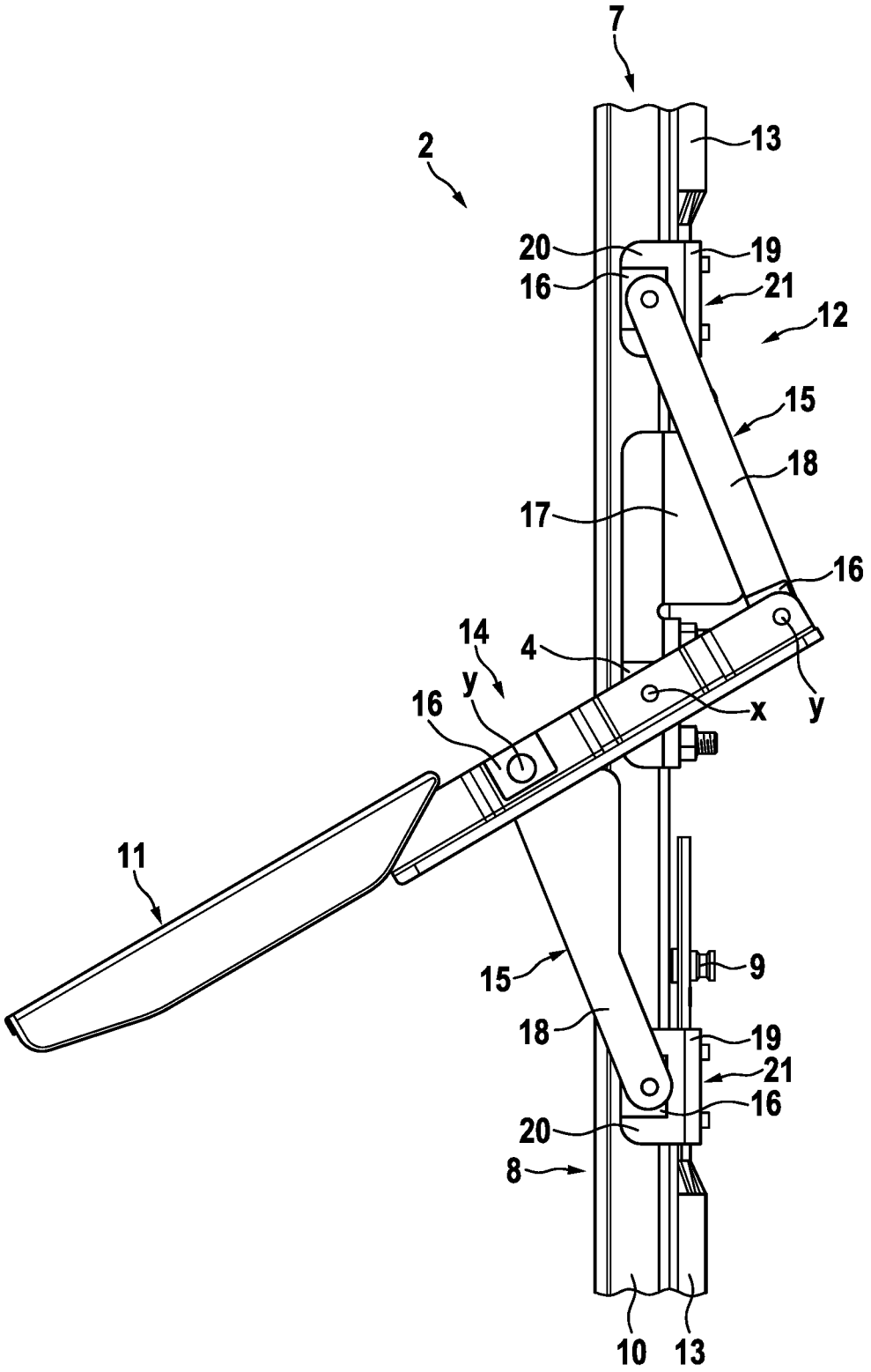
Figure 3:
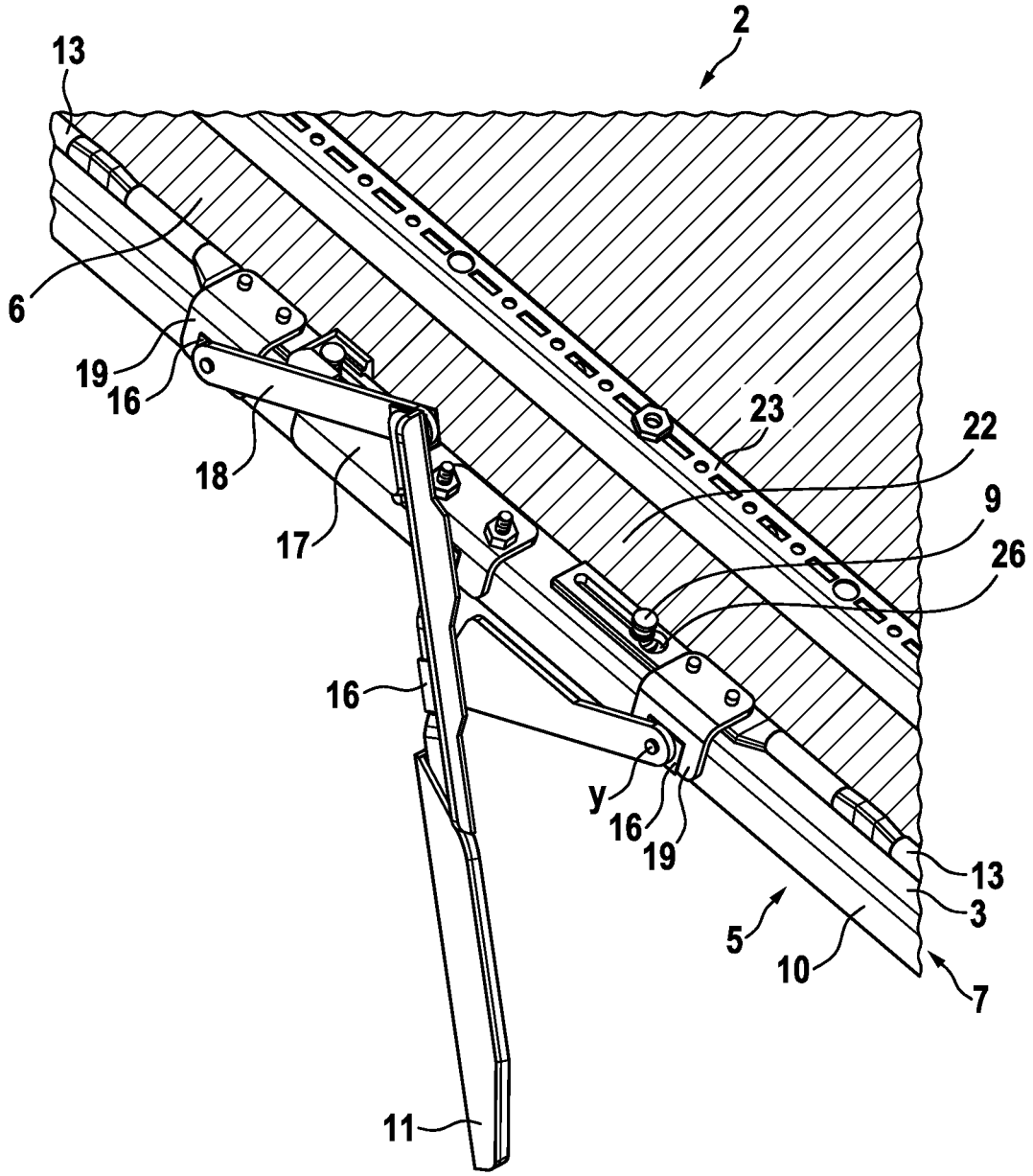
Figure 4:
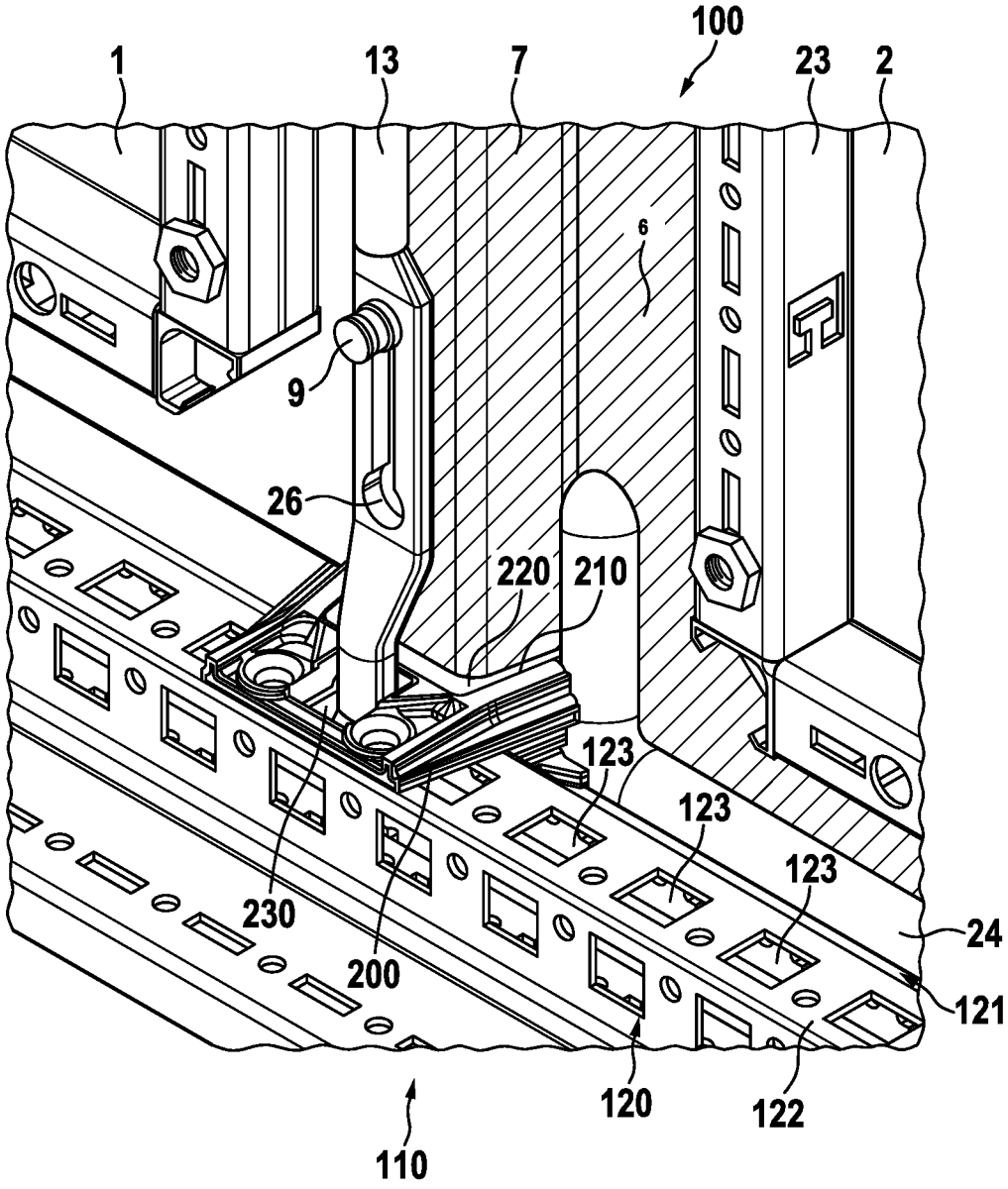
Figure 5:
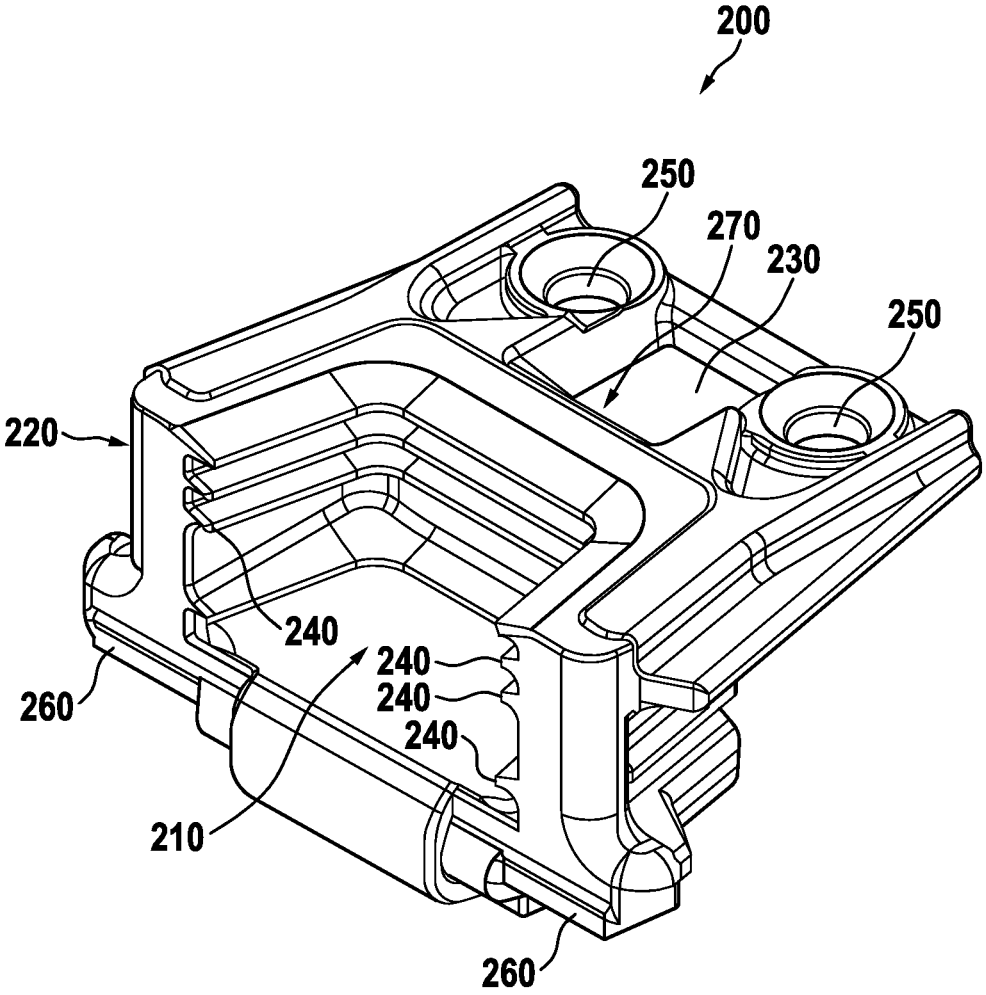
Figure 6:
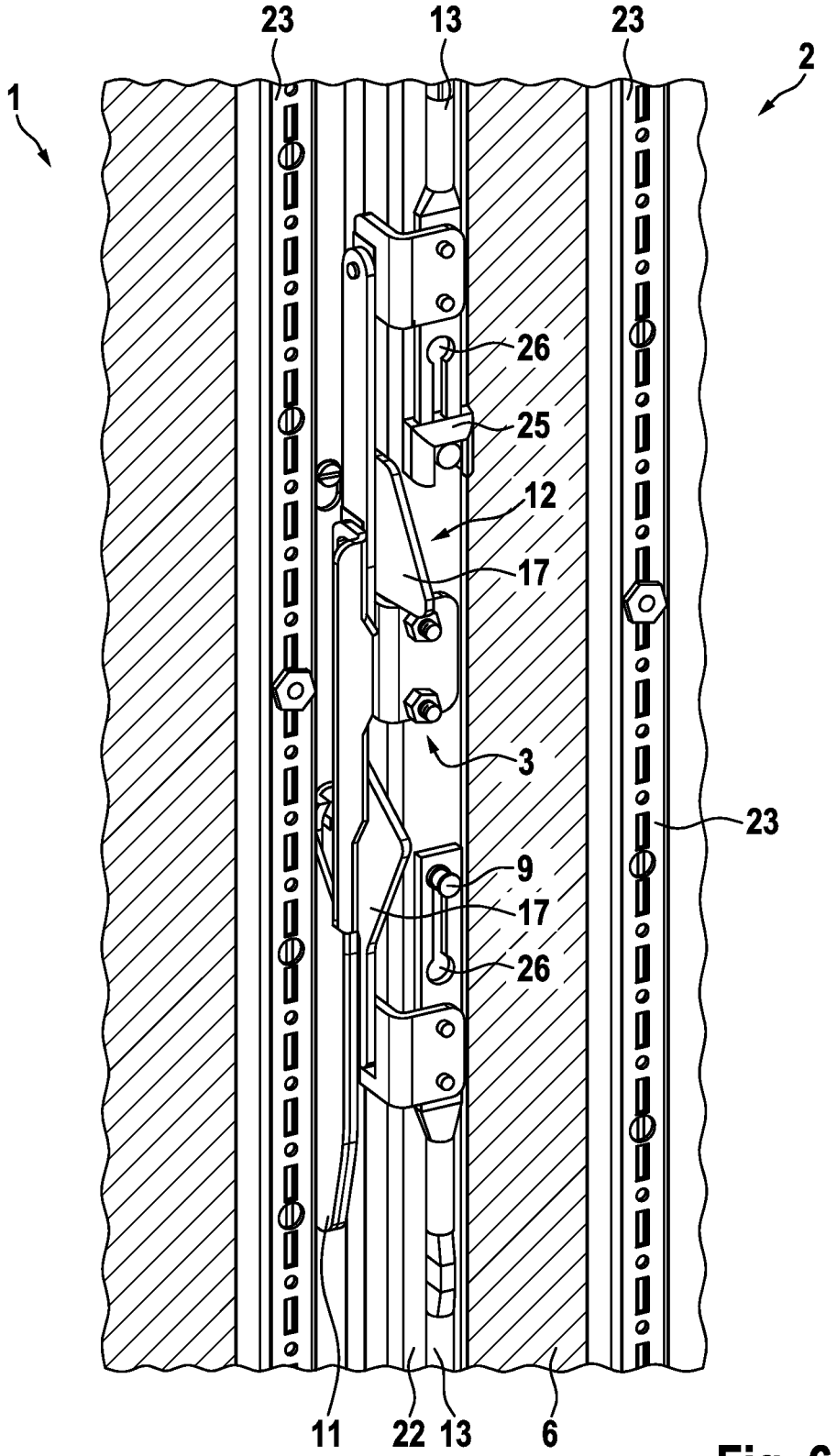
Figure 7:
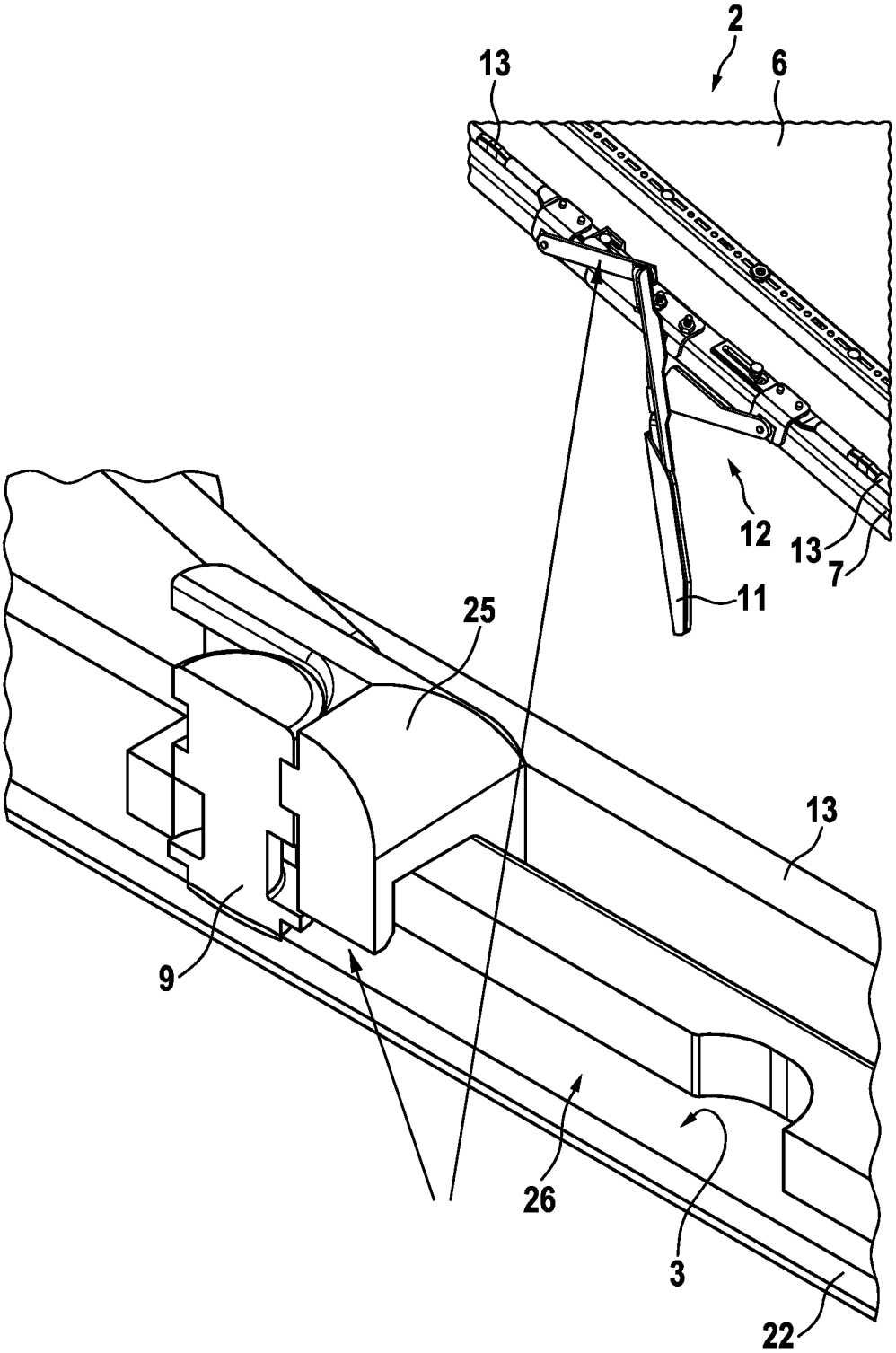
Figure 8:
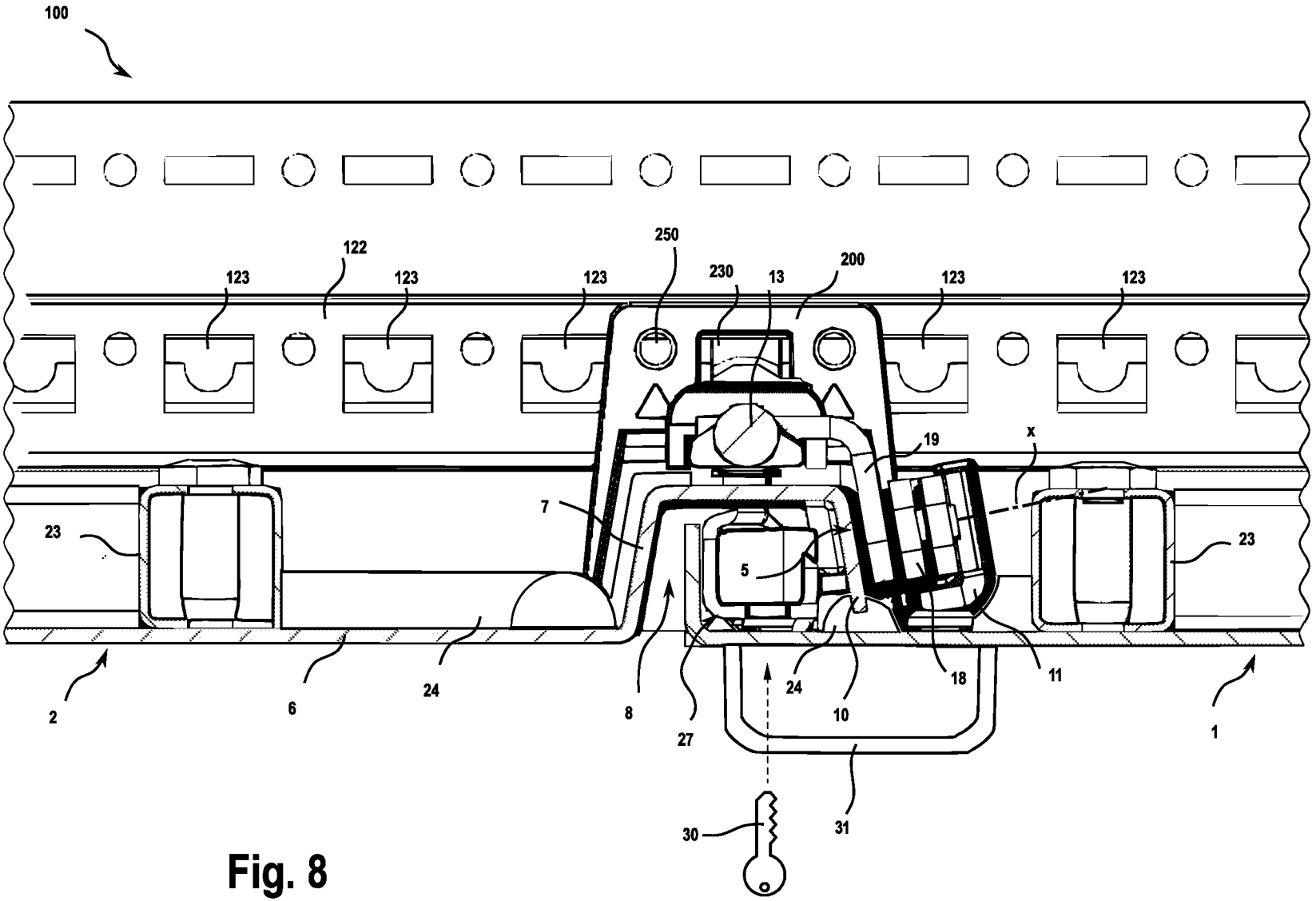

Further details of the invention are explained using the figures below. These show:

FIG. 1 in perspective view, a secondary door with a swivelling lever arranged in the open position;

FIG. 2 the embodiment according to FIG. 1 in plan view of the vertical face of the locking device;

FIG. 3 a perspective view of the rear of the locking device according to FIG. 1 facing the switch cabinet interior;

FIG. 4 a perspective view of the side of the lock door and secondary door facing the switch cabinet interior in the area of the base frame of the switch cabinet FIG. 5 a perspective view of a sealing center piece according to an embodiment of the invention;

FIG. 6 a perspective view of the side of the lock door and secondary door facing the switch cabinet interior according to another embodiment of a locking device in the locking position of both the secondary door lock as well as the lock door and secondary door;

FIG. 7 a detailed view of another embodiment of a locking device according to the invention; and FIG. 8 a horizontal cross section of the switch cabinet with the doors in a closed position.

DETAILED DESCRIPTION

Example embodiments will now be described more fully with reference to the accompanying drawings.

To simplify the illustration, the locking device for a switch cabinet shown in FIG. 1 is shown without the lock door 1, which is complementary to the secondary door 2 shown. The secondary door 2 is designed as a sheet metal part with a door leaf 6, on the vertical longitudinal edge of which a U-profile 7 is integrally formed, in particular bent from the door leaf 6. Such a secondary door 2 is known from DE 198 06 064 C1, for example.

On an outer end face, the U-profile 7 has an outer free profile side 10 to which the swivelling lever 11 is parallelly pivotable between an open position and a locking position of the locking mechanism 12 of the secondary door 2. In particular, the swivelling lever 11 can be rotated about an axis of rotation x, which extends perpendicular to the outer free profile side 10 of the U-profile 7.

With respect to the axes of rotation x, which are located before and after the axis of rotation y, a toggle lever 15 is fixed to the swivelling lever 11 via a rotary connector 16 so that it can rotate relative to the swivelling lever 11. The two toggle levers 15 are connected at their ends facing away from the swivelling lever 11 via a further rotary connector 16 each to a coupling element 19, via which the toggle levers 15 are each coupled to a push rod arranged on the rear side of the U-profile 7. While the push rod mechanism, as in the case of the locking devices known from the state of the art, is thus still arranged on the side of the secondary door facing the switch cabinet interior, the secondary door lock 12 and in particular its swivelling lever 11 is accessible via the front side of the secondary door 2, so that the secondary door 2 is easy to handle.

With reference to FIGS. 2 and 3, further details of the locking device shown in FIG. 1 become clear. In particular, the toggle lever 15, which projects beyond the front of the secondary door 2 in the open position of the secondary door lock 12, has a pinch protection cover 17 formed on a toggle lever rod 18 of the toggle lever 15. As shown in FIG. 2, the pinching protection cover 17 covers the area between the outer free profile side 10 of the U-profile 7, the toggle lever rod 18 protruding from the front of the secondary door 2, and the swivelling lever 11, in order to prevent fingers from being caught when pivoting the swivelling lever 11 and thus preventing the aforementioned components of the scissor element 14 from shifting relative to each other.

On the outer side 3 of the further profile side 22 of the U-profile 7, the outer side facing the switch cabinet interior, a further pinch protection 17 is attached, which extends beyond the outer side 3 and thus in the installation situation in the direction of the switch cabinet interior. The further pinch protection cover 17 can be attached to the U-profile 7, for example screwed to the further profile side 22 of the U-profile 7.

FIG. 2 further shows that the push rods 13 are fixed to the further profile side 22 of the U-profile 7 by means of a welded bolt 9, whereby in an end area where the push rods 13 are placed on the bolt 9 via a keyhole, the push rods 13 have an oblong hole along which the respective push rod 13 can be moved across the respective bolt 9. Further details are shown in FIG. 3.

The two toggle levers 15 are each connected to the push rod via an L-shaped coupling element 19. While the toggle levers 15 can be pivoted in a plane that extends parallel to the outer free profile side 10 of the U-profile 7, the translatory linear movement achieved with the aid of the scissor element 14 is shifted via the L-shaped coupling elements 19 in a plane that extends along the outer side 3 of the other profile side 22 of the U-profile 7 at the rear of the secondary door 2. In this way it is possible that, when the push rod mechanism is arranged behind the secondary door 2 in a covered manner, the swivelling lever 11 itself can be arranged in front of the secondary door 2 and thus can be easily accessible for a user. The combination of FIGS. 1 to 3 also shows that the shown embodiment has been realized with simple technical means. For example, the L-shaped coupling elements can also be formed as simple, edged sheet metal parts.

FIG. 4 shows an exemplary embodiment of a switch cabinet 100 in the area of the base frame of the frame 110. The base frame has a front horizontal strut 120, which limits the door-side opening of the frame 110 on the base side. The lock door 1 and the secondary door 2 are hinged to opposite vertical profiles (not shown) of the frame 110, as known from DE 10 2016 117 378 B3, for example.

The horizontal strut 120 of the frame 110 connects the opposite ends of the vertical profiles with each other and has a sealing center piece 200, which is attached to the horizontal strut 120 via a profile receptacle 210 open to the outside of the frame 110. A sealing element 220 is accommodated in the profile receptacle 210, which seals the U-profile 7 of the secondary door 2 at its bottom longitudinal end against the profile receptacle 210.

A suitable base frame is known from DE 10 2015 121 193 B4, for example. The horizontal strut 120 of the embodiment shown in FIG. 4 is formed accordingly and therefore has a Z-edge 121 on its outer circumference, via which the sealing center piece 200 is attached to the horizontal strut 120. In addition, an upper horizontal profile side 122 of the Z-edge 121 has a system perforation of regularly spaced fastening receptacle 123. The sealing center piece 200 has a passage 230 which is aligned with one of the fastening receptacles 123 for the free end of the push rod 13 of the lock 12, whereby the free end of the push rod 13 in the locking position extends through the passage 230 and the aligned fastening receptacle 123 into the horizontal strut 120 and thus locks the secondary door against the frame.

As can be seen in FIG. 5, the passage 230 has a run-up slope 270, which the free end of the push rod meets when the push rod 13 is moved from its release position to the locking position. Thereby, the U-profile 7 is pressed further into the profile receptacle 210 under pre-tension of the sealing element 220, wherein the sealing element 220 is compressed and thus an effective sealing of the U-profile 7 of the secondary door 3 against the frame is achieved.

In particular, the sealing center piece 200 can be formed as a plastic moulding and the sealing element 220 can line the profile receptacle 210 along its inner circumference. The sealing element 220 has several sealing lips 240 spaced parallel to each other and projecting horizontally from the inner circumference.

The combination of FIGS. 4 and 5 also shows that the sealing element 220 has at its end protruding from the profile holder 210 a sealing web 260 opposite each, with which the sealing center piece 200 is sealed in the closed position of the secondary door 2 shown in FIG. 4 against a seal 24 applied to the inner side of the secondary door 2.

Analogously, a further sealing center piece can be arranged on an upper horizontal strut of the frame, which seals the U-profile 7 at its upper end against the frame. With the aid of the sealing center pieces and the seal 24 applied to the inner sides of the door, it is possible to achieve a circumferentially closed sealing of the switch cabinet door side against the switch cabinet frame.

FIG. 6 shows an embodiment of a locking device in the locking position, in which all components of the scissor element, in particular the two toggle levers 15 and the swivelling lever 11 itself, are arranged in alignment with the outer free profile side 10 of the U-profile 7, thus saving space, so that, on the one hand, when closing the lock door of the locking device, the secondary door lock 12 cannot collide with the lock door and, on the other hand, the elements of the scissor element 14 also cannot protrude into the installation space of the switch cabinet housing and collide with switch cabinet installations there. The only elements of the locking device that project beyond the push rod mechanism into the interior of the switch cabinet housing are the pinch protection covers 17. In one embodiment these can be detachably connected to the toggle lever rod 18 or the U-profile 7 respectively, so that in the application where there is a risk of collision between the pinch protection covers 17 and switch cabinet internals, the use of the pinch protection covers 17 can be omitted at the expense of the pinch protection.

A tubular door frame 23 each is arranged on the inner sides of lock door 1 and secondary door 2, the tubular door frame 23 on the lock door side being arranged in such a way that, in the closed position of secondary door 2 and lock door 1 shown in FIG. 6, sufficient space is created between the outer free profile side 10 of the U-profile 7 and the tubular door frame 23 to accommodate the secondary door lock 12 between the tubular door frame 23 and the outer free profile side 10 in the locking position of the secondary door lock 12.

With reference to FIG. 7, the attachment of the push rod mechanism on the outer side 3 of the further profile side 22 of U-profile 7 is shown. Weld bolts 9 are fixed to the further profile side 22 via the outer side 3, onto which the push rods are in turn attached via a keyhole-shaped oblong hole. In order to prevent the push rods 13 from coming loose from the bolt 9, the push rods are secured by means of a securing attachment 25 placed on the bolts, which additionally has the function of a stop by engaging in the oblong-shaped keyhole 26, as shown in the lower detailed view of FIG. 7, so that the part of the securing attachment 25 engaging in the hole 26 forms a stop which prevents the bolt 9 from aligning with the wide end of the keyhole 26 and thus prevents the push rod 13 from coming loose.

In summary, FIG. 8 shows the secondary door 2 and lock door 1 in the closed position. The door leaf 6 of the secondary door 2 terminates in the U-profile 7. The U-profile 7 is offset towards the interior of the switch cabinet to provide a receptacle 8 opening towards the exterior of the cabinet for receiving for a bent end portion of the lock door 1. The U-profile 7 has a leg portion 5 formed from a free profile and of the door leaf 6 of the secondary door 2. The swiveling lever 11 of the secondary door lock is connected to the leg 5 of the U-profile 7 about an axis of rotation x between an open position and a locking position. When the swiveling lever 11 is in the closed position, it is located completely interiorly of the door leaf 6. A key 30, for example, can be used to engage a lock mechanism 27 to secure the locked door 1 in a locked position. To open the doors, the key 30 can be used to unlock the lock door 1 and a handle 31, for example, can be grasped by the user to pull open the lock door 1. Then, the swiveling lever 11 can be rotated to unlock the secondary door 2.

The features of the invention disclosed in the above description, drawings and claims may be essential for the realisation of the invention either individually or in any combination.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A locking device for a switch cabinet, the switch cabinet having a lock door and a secondary door that swing between open and closed positions about side hinges, said locking device comprising:

a door leaf for the secondary door, the door leaf terminating opposite its hinge in a U-profile, the U-profile being oriented towards the interior of the cabinet to provide a receptacle opening facing towards the front exterior of the cabinet, the receptacle receiving a portion of the lock door when the lock door is closed;

the U-profile having a leg portion formed from a free profile side end of the door leaf of the secondary door and extending towards the front exterior of the cabinet; and a lock for the secondary door, the lock having a swiveling lever connected to the leg of the U-profile mounted about an axis of rotation between an open position and a locking position.

2. The locking device according to claim 1, in which the swivelling lever is pivotable in a plane between the open position and the locking position, which plane extends parallel to the free profile side.

3. The locking device according to claim 1, in which the axis of rotation extends perpendicular to the free profile side of the U-profile.

4. The locking device according to claim 1, in which the free profile side extends at least approximately perpendicular or at an obtuse angle to the door leaf.

5. The locking device according claim 1, in which, in the open position, the swivelling lever extends to the front of the secondary door beyond the door leaf plane, and in which in the locking position, the swivelling lever is arranged completely behind the door leaf plane.

6. The locking device according to claim 1, in which the lock of the secondary door comprises a first and a second push rod, to which the swivelling lever is mechanically coupled via a scissor element, the push rods extending along an outer side of a further profile side of the U-profile arranged on the rear side of the secondary door, which further profile side is formed by a bent edge on the outer free profile side of the U-profile.

7. The locking device according to claim 1, in which the lock of the secondary door comprises a first and a second push rod to which the swivelling lever is mechanically coupled via a scissor element, wherein a first toggle lever of the scissor element is connected at opposite ends to the first push rod and the swivelling lever via a respective first rotary connector and a second toggle lever of the scissor element is connected at opposite ends to the second push rod and the swivelling lever via a respective second rotary connector.

8. The locking device according to claim 7, in which in each setting position of the swivelling lever, at least one of the toggle levers overlaps over its entire length with the outer free profile side of the U-profile or a pinch protection cover fixed thereto and projecting beyond it.

9. The locking device according to claim 7, in which at least one of the toggle levers has a toggle lever rod and a V-shaped pinch protection cover which is either integrally formed on the toggle lever rod or releasably connected to it.

10. The locking device according to claim 7, in which the toggle levers are each connected to the respective push rod via an L-shaped coupling element, which has a first attachment side which extends parallel to the outer free profile side of the U-profile and which has the rotary connector, and which coupling element has a second attachment side, which is connected to the push rod and extends parallel to an outer side of a further profile side of the U-profile arranged at the rear of the secondary door.

11. The locking device according to claim 7, in which a pinch protection cover is fixed to the U-profile and extends parallel to the outer free profile side of the U-profile and protrudes from the rear of the U-profile.

12. The locking device according to claim 7, in which, in the open position of the swivelling lever, a first of the toggle levers extends parallel to the outer free profile side of the U-profile and protrudes from the rear of the U-profile.

13. The locking device according to claim 7, in which, in the open position of the swivelling lever, a second of the toggle levers extends parallel to the outer free profile side of the U-profile and protrudes over the front of the U-profile.

14. The locking device according to claim 7, in which the toggle levers are attached to the swivelling lever oppositely with respect to the axis of rotation of the swivelling lever, wherein further axes of rotation of the rotary connectors connecting the toggle levers to the swivelling lever are arranged between the toggle levers and the swivelling lever parallel to the axis of rotation of the swivelling lever.

15. The locking device according to claim 14, in which, in the open position of the swivelling lever, the other axes of rotation are arranged oppositely in relation to the door leaf and protrude relative to the door leaf as well as the U-profile on opposite sides thereof, wherein, in the locking position of the swivelling lever, the other axes of rotation are situated in front of the outer free profile side of the U-profile.

16. A switch cabinet, which has a locking device according to claim 1, the lock door and the secondary door being hinged to opposite vertical profiles of a frame of the switch cabinet, wherein in a closed position of lock door and secondary door the receptacle of the secondary door is covered by the lock door.

17. The switch cabinet according to claim 16, in which the frame has a horizontal strut which connects opposite ends of the vertical profiles to one another, wherein a sealing center piece with a profile receptacle open to the outer side of the frame is attached to the horizontal strut, and wherein a sealing element is accommodated in the profile receptacle which seals the U-profile at one of its longitudinal ends with respect to the profile receptacle.

18. The switch cabinet according to claim 17, in which the sealing center piece is attached to a Z-edge of the horizontal strut, wherein an upper horizontal profile side of the Z-edge has a system perforation of regularly spaced fastening receptacles, wherein the sealing center piece has a passage aligned with one of the fastening receptacles for the free end of a push rod of the lock, and wherein the free end extends into the horizontal strut through the passage and the aligned fastening receptacle in the locking position of the swivelling lever.

19. The switch cabinet according to claim 17, in which the sealing center piece comprises a hard component having the profile receptacle and a soft component forming the sealing element, the sealing element lining the profile receptacle along its inner circumference, wherein the sealing element has several sealing lips spaced parallel to one another and projecting horizontally from the inner circumference.

20. The switch cabinet according to claim 17, in which on a side facing the interior of the frame, the profile receptacle has a cut-out into which a portion of the sealing element projects.

* * * * *